US009234402B2

(12) United States Patent
Vinge

(10) Patent No.: US 9,234,402 B2
(45) Date of Patent: Jan. 12, 2016

(54) METHOD FOR MODIFYING AN EXISTING SUBSEA ARRANGED OIL PRODUCTION WELL, AND A THUS MODIFIED OIL PRODUCTION WELL

(75) Inventor: Torstein Vinge, Heimdal (NO)

(73) Assignee: STATOIL PETROLEUM AS, Stavanger (NO)

( * ) Notice: Subject to any disclaimer, the term of this patent is extended or adjusted under 35 U.S.C. 154(b) by 813 days.

(21) Appl. No.: 13/127,410

(22) PCT Filed: Oct. 29, 2009

(86) PCT No.: PCT/NO2009/000379

§ 371 (c)(1),
(2), (4) Date: Jun. 30, 2011

(87) PCT Pub. No.: WO2010/062181

PCT Pub. Date: Jun. 3, 2010

(65) Prior Publication Data

US 2011/0253379 A1 Oct. 20, 2011

(30) Foreign Application Priority Data

Nov. 3, 2008 (NO) ..... 20084628

(51) Int. Cl.

| | |
|---|---|
| ***E21B 7/12*** | (2006.01) |
| ***E21B 33/076*** | (2006.01) |
| ***E21B 34/04*** | (2006.01) |
| ***E21B 34/06*** | (2006.01) |
| ***E21B 43/12*** | (2006.01) |

(52) U.S. Cl.

CPC ..... *E21B 33/076* (2013.01); *E21B 34/04* (2013.01); *E21B 34/06* (2013.01); *E21B 43/128* (2013.01)

(58) Field of Classification Search

CPC ..... E21B 4/18; E21B 21/10; E21B 2034/007; E21B 49/08

USPC ..... 166/344, 373, 381, 66.6, 68, 77.2, 85.1, 166/105; 251/129.03; 137/269, 271

See application file for complete search history.

(56) References Cited

U.S. PATENT DOCUMENTS

| | | | | |
|---|---|---|---|---|
| 3,361,206 | A * | 1/1968 | Raulins | 166/312 |
| 4,024,913 | A * | 5/1977 | Grable | 166/72 |
| 4,440,221 | A * | 4/1984 | Taylor et al. | 166/106 |
| 4,580,634 | A * | 4/1986 | Cruise | 166/310 |
| 4,627,496 | A * | 12/1986 | Ashford et al. | 166/292 |
| RE32,866 | E * | 2/1989 | Cruise | 166/310 |
| 4,869,324 | A * | 9/1989 | Holder | 166/387 |

(Continued)

FOREIGN PATENT DOCUMENTS

| | | |
|---|---|---|
| GB | 2 359 317 B | 7/2002 |
| GB | 2 439 175 A | 12/2007 |

(Continued)

*Primary Examiner* — Matthew Buck
*Assistant Examiner* — Aaron Lembo
(74) *Attorney, Agent, or Firm* — Birch, Stewart, Kolasch & Birch, LLP

(57) ABSTRACT

Method to modify an existing subsea arranged oil production well having installed a hydraulically operated downhole valve, characterized in using coiled tubing technology to: arrange an electrically operated downhole pump in the production tubing, lock the hydraulically operated downhole valve in an open position by placing a sleeve body in the open positioned valve, arrange an electrically operated downhole valve above the downhole pump. A modified oil production well.

10 Claims, 5 Drawing Sheets

(56) References Cited

U.S. PATENT DOCUMENTS

Figure 1:
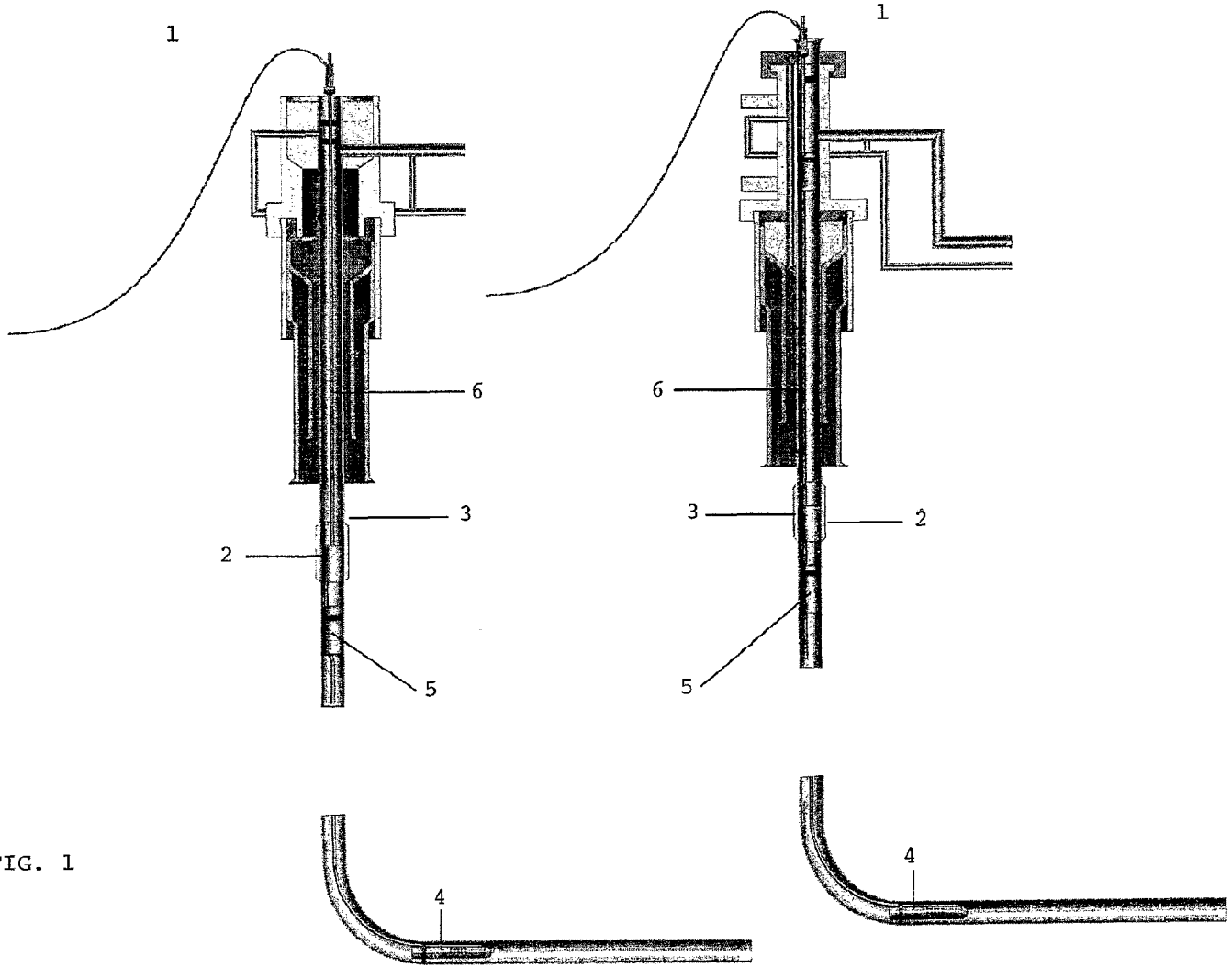

| | | | | |
|---|---|---|---|---|
| 4,928,759 | A * | 5/1990 | Siegfried et al. | 166/65.1 |
| 4,938,060 | A * | 7/1990 | Sizer et al. | 73/152.58 |
| 5,180,014 | A * | 1/1993 | Cox | 166/384 |
| 5,350,018 | A * | 9/1994 | Sorem et al. | 166/250.07 |
| 5,394,951 | A * | 3/1995 | Pringle et al. | 175/61 |
| 5,398,753 | A * | 3/1995 | Obrejanu et al. | 166/98 |
| 5,400,856 | A * | 3/1995 | Schmidt | 166/271 |
| 5,485,745 | A * | 1/1996 | Rademaker et al. | 73/152.39 |
| 5,522,463 | A * | 6/1996 | Barbee | 166/68 |
| 5,638,904 | A * | 6/1997 | Misselbrook et al. | 166/384 |
| 5,807,082 | A * | 9/1998 | Skinner et al. | 417/375 |
| 5,865,250 | A * | 2/1999 | Gariepy | 166/375 |
| 5,920,032 | A * | 7/1999 | Aeschbacher et al. | 174/47 |
| 6,068,015 | A * | 5/2000 | Pringle | 137/155 |
| 6,089,832 | A | 7/2000 | Patterson | |
| 6,102,125 | A * | 8/2000 | Calder | 166/359 |
| 6,176,308 | B1 * | 1/2001 | Pearson | 166/65.1 |
| 6,192,983 | B1 * | 2/2001 | Neuroth et al. | 166/250.15 |
| 6,220,358 | B1 * | 4/2001 | Leniek, Sr. | 166/369 |
| 6,257,332 | B1 * | 7/2001 | Vidrine et al. | 166/250.15 |
| 6,321,848 | B1 * | 11/2001 | Funk | 166/383 |
| 6,328,111 | B1 * | 12/2001 | Bearden et al. | 166/381 |
| 6,352,118 | B1 * | 3/2002 | Dickson et al. | 166/373 |
| 6,488,093 | B2 * | 12/2002 | Moss | 166/339 |
| 6,527,052 | B2 * | 3/2003 | Ringgenberg et al. | 166/336 |
| 6,561,775 | B1 * | 5/2003 | Wefers | 417/423.3 |
| 6,695,060 | B1 * | 2/2004 | Guidry et al. | 166/370 |
| 6,729,391 | B2 * | 5/2004 | Hill et al. | 166/68.5 |
| 6,729,398 | B2 * | 5/2004 | Ringgenberg et al. | 166/250.01 |
| 6,857,486 | B2 * | 2/2005 | Chitwood et al. | 175/104 |
| 6,962,215 | B2 * | 11/2005 | Curtis et al. | 175/257 |
| 7,219,743 | B2 * | 5/2007 | Wolters et al. | 166/377 |
| 7,264,058 | B2 * | 9/2007 | Fossli | 166/367 |
| 7,637,326 | B2 * | 12/2009 | Bolding et al. | 166/375 |
| 7,677,320 | B2 * | 3/2010 | Shaw et al. | 166/368 |
| 7,770,653 | B2 * | 8/2010 | Hill et al. | 166/379 |
| 7,784,553 | B2 * | 8/2010 | Moreno | 166/386 |
| 7,896,087 | B2 * | 3/2011 | Dallas | 166/381 |
| 8,104,534 | B2 * | 1/2012 | Olson et al. | 166/105 |
| RE43,199 | E * | 2/2012 | Fossli | 166/367 |
| 8,122,975 | B2 * | 2/2012 | Belcher et al. | 175/57 |
| 8,132,621 | B2 * | 3/2012 | Pettinato et al. | 166/250.01 |
| 8,132,630 | B2 * | 3/2012 | Krueger et al. | 175/25 |
| 8,220,553 | B2 * | 7/2012 | Crawford | 166/368 |
| 8,286,712 | B2 * | 10/2012 | Wilson | 166/338 |
| 8,297,359 | B2 * | 10/2012 | McKay et al. | 166/359 |
| 8,490,687 | B2 * | 7/2013 | Scott et al. | 166/66.7 |
| 8,517,111 | B2 * | 8/2013 | Mix et al. | 166/363 |
| 8,573,325 | B2 * | 11/2013 | Maida et al. | 175/24 |
| 8,613,311 | B2 * | 12/2013 | Xiao et al. | 166/105 |
| 2004/0188096 | A1 | 9/2004 | Traylor | |
| 2005/0016735 | A1 * | 1/2005 | Ireland et al. | 166/352 |
| 2005/0189116 | A1 | 9/2005 | See | |
| 2007/0289747 | A1 | 12/2007 | Shaw et al. | |
| 2007/0295504 | A1 * | 12/2007 | Patel | 166/263 |
| 2008/0223585 | A1 * | 9/2008 | Patel et al. | 166/385 |
| 2010/0025045 | A1 * | 2/2010 | Lake et al. | 166/373 |
| 2011/0056681 | A1 * | 3/2011 | Khan | 166/254.2 |
| 2011/0247828 | A1 * | 10/2011 | Patel et al. | 166/348 |
| 2011/0303420 | A1 * | 12/2011 | Thorkildsen et al. | 166/373 |

FOREIGN PATENT DOCUMENTS

| | | | |
|---|---|---|---|
| WO | WO 00/31417 | A1 | 6/2000 |
| WO | WO 2004/076797 | A2 | 9/2004 |

* cited by examiner

METHOD FOR MODIFYING AN EXISTING SUBSEA ARRANGED OIL PRODUCTION WELL, AND A THUS MODIFIED OIL PRODUCTION WELL

TECHNICAL FIELD

The present invention concerns oil production wells arranged subsea. More particular, the invention concerns a method for modifying an existing subsea arranged oil production well having an already installed hydraulically operated downhole valve, in addition to a modified subsea arranged oil production well.

BACKGROUND AND PRIOR ART

Many oil reservoirs have a relatively low pressure which limits the production. If a new well is going to be arranged in such a reservoir, the well may be supplemented is with a deeply located downhole pump. A deeply located/arranged downhole pump may be post-installed in wells with dryly arranged wellhead, i.e. the wellhead is onshore or dryly on a steady installation, by applying coiled tubing technology to lower and arrange a pump in the production tubing of the well, the coiled tube is used to lower the pump and to contain a power cable. The above mentioned technology is applied today, for example in Yme field of Statoil which contains a steady platform with dryly arranged wellhead.

For existing wells having low pressure and subsea arranged wellhead, no simple solution to increase the well production by installing a deeply arranged downhole pump in the production tubing exists today. Such installation would today require that the tubing is pulled out and the well being recompleted. There is a need for a simple solution to increase the production from an existing subsea arranged oil production well. By simple solution it is here meant the arrangement of a downhole pump deep down in the tubing without pulling out the tubing and to recomplete the well.

An existing oil producing well having low pressure would typically be in a final stage of its production lifetime, in which the pressure in the reservoir has fallen to a low level that limits the production. The well would typically be equipped with existing hydraulically operated systems, included a hydraulically operated downhole valve in the tubing close to the upper part of the well. One object with the present invention is to provide a method to modify a well of the above mentioned type, together with a thus modified well, to render possible the installation of a downhole pump without having to pull out the tubing and to recomplete the well.

SUMMARY OF THE INVENTION

The above mention objective and requirement is surprisingly met with the present invention.

More particularly, the invention provides a method to modify an existing subsea arranged oil production well having installed a hydraulically operated downhole valve, characterized in that it uses coiled tubing technology to:

arrange an electrically operated downhole pump in the production tubing, lock the hydraulically operated downhole valve in an open position by arranging a sleeve body in the open valve, and arrange an electrically operated downhole valve above the downhole pump.

The invention also provides a modified subsea arranged oil production well, the well being modified by applying the method according the invention. The well is characterized in that it comprises:

an electrically operated downhole pump in the production tubing, a sleeve body that locks a prior arranged hydraulically operated downhole is valve within the production tubing in an open position, and an electrically operated downhole valve in the production tubing, above the downhole pump.

A coiled tubing hanger is advantageously arranged on the well head, on which a coiled tubing string may be detached in a sealing way and a completion/workover riser may be connected and disconnected. More particularly, the coiled tubing hanger is arranged on the existing hydraulically operated valve tree (Christmas tree) and advantageously comprises an electrical connector, operable by ROV (remotely operated vehicle), an upper part, for connection of power and control signals to the pump, and the downhole valve.

The electrically operated downhole pump is preferably arranged deep down in the production tubing. For horizontal wells the electrically operated downhole pump is preferably arranged at depths corresponding to the depth of the horizontal part of the well. Preferably the downhole pump has electrically operable packers that lock the pump to the position in the production tubing. The pump hangs in the coiled tubing, in which tubing an electrical cable is located. To maintain the barrier with a downhole valve (since the existing hydraulically operated downhole valve cannot close due to the coiled tubing), the sleeve body is arranged in the position so that the existing hydraulically operated valve is locked in an open position while a new electrically operated downhole valve is arranged within the production tubing above the downhole pump. The sleeve body and the electrically operated valve may advantageously be integrated in one unit, which thereby may be arranged in the production tubing in one single step. The downhole valve may thereby close the flow through the production tubing.

The operation is thought implemented as a coiled tubing operation from a semi-submersible, that is having equipment for pressure control in form of a riser, coiled tubing blowout preventer, injection head and stripping assembly, corresponding to a standard coiled tubing operation in a subsea well. The coiled tubing string may be led down in the production tubing while the well is open since pressure control takes place on the semi-submersible. If necessary the well may be "killed" by pumping in heavy liquid that balance the reservoir pressure. Alternatively, modification may be performed while the well is in operation since all equipment that is led down in the well must be locked in as with a normal coiled tubing intervention on a well in operation. After the operation the coiled tubing above the coiled tubing hanger is disconnected, and the riser is disconnected, preferably in that sequence. The term "using coiled tubing technology" is meant to include the above steps.

The existing hydraulically based operation system will not have the sufficient power to handle, i.e. to operate, the downhole valve. Upgrading the hydraulic system is a comprehensive task. In addition it is important that the downhole pump must be easy changeable. This is considered much easier using the present solution compared with solution using hydraulic operation.

FIGURES

Figure 2:
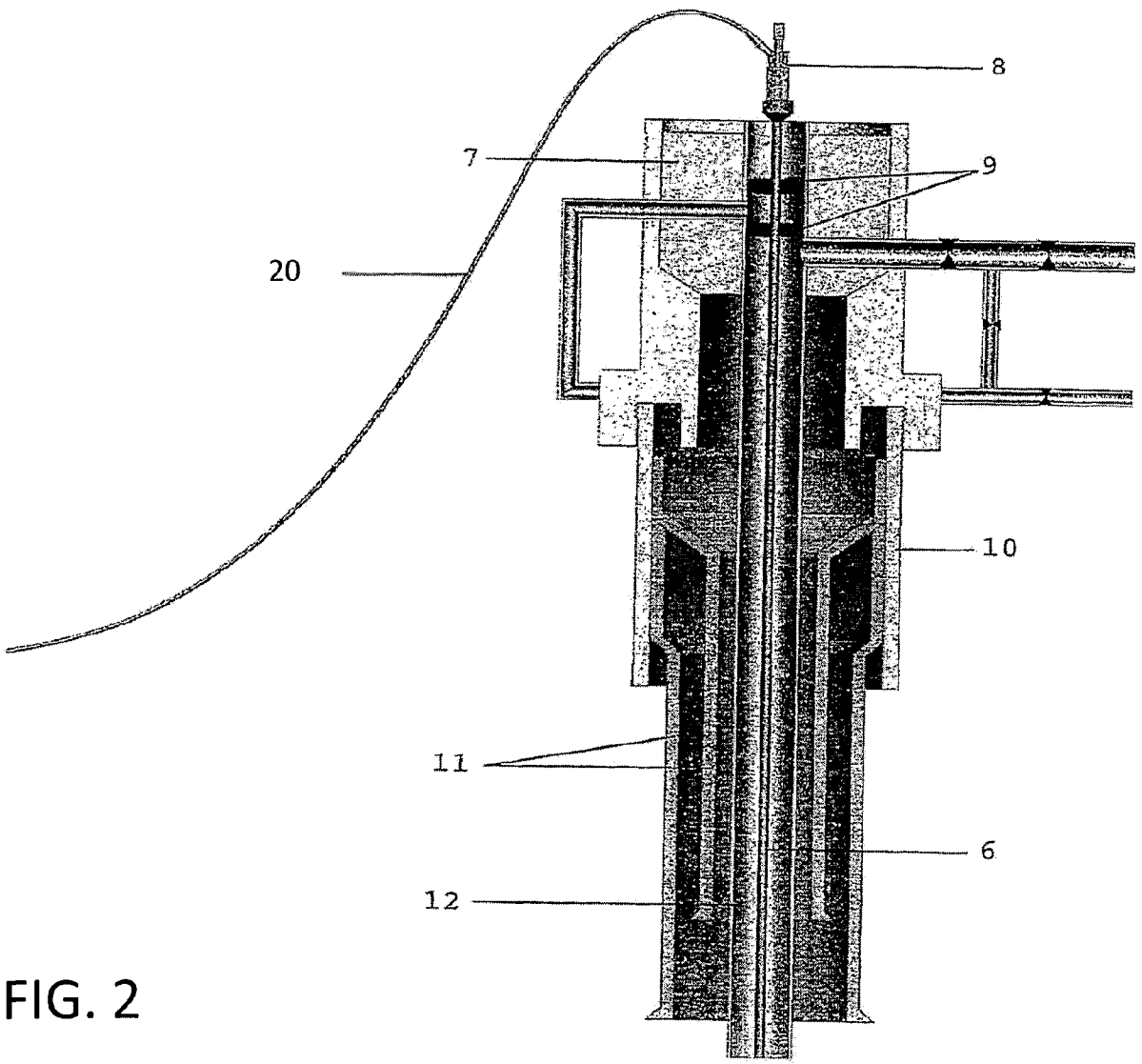
Figure 3:
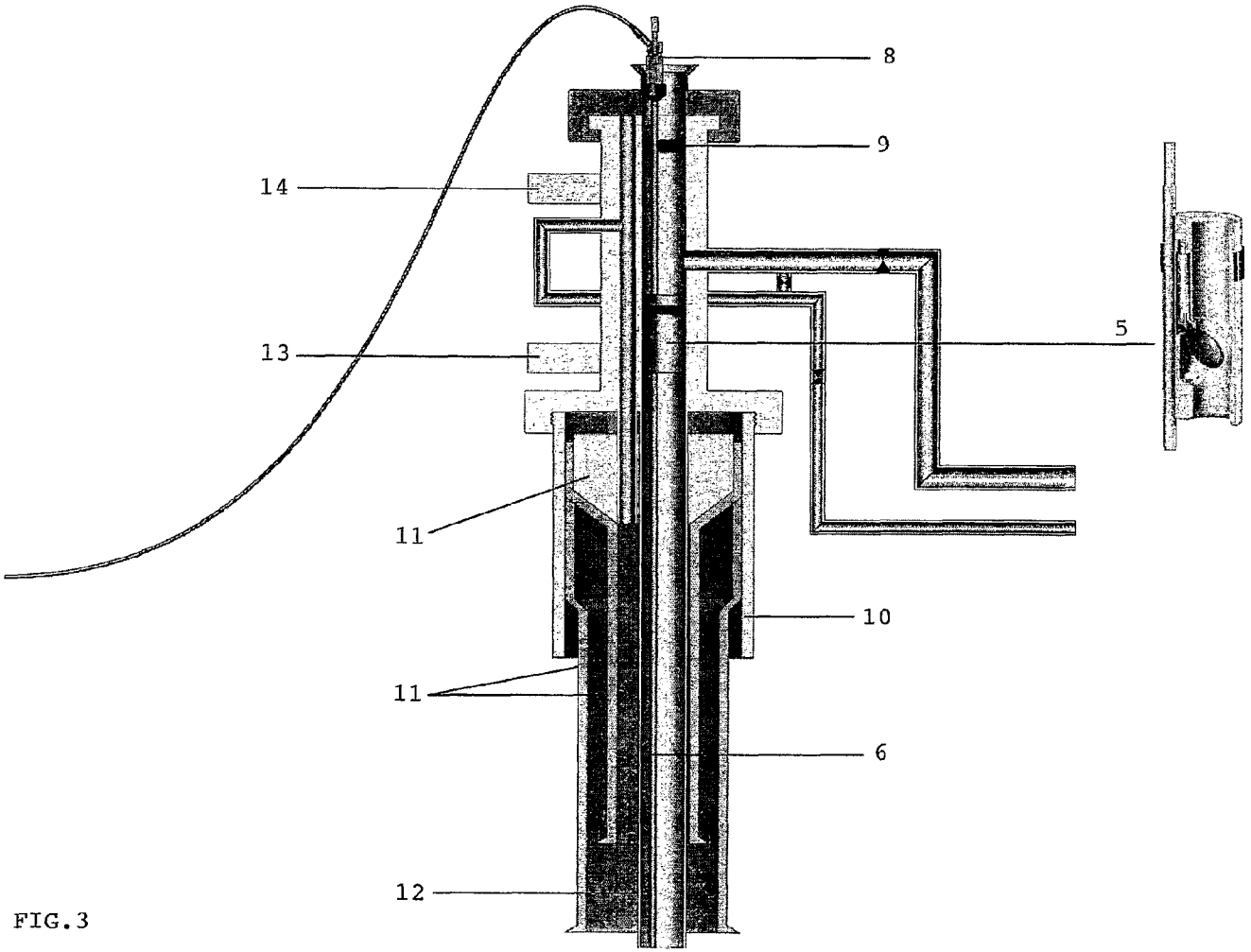
Figure 4:
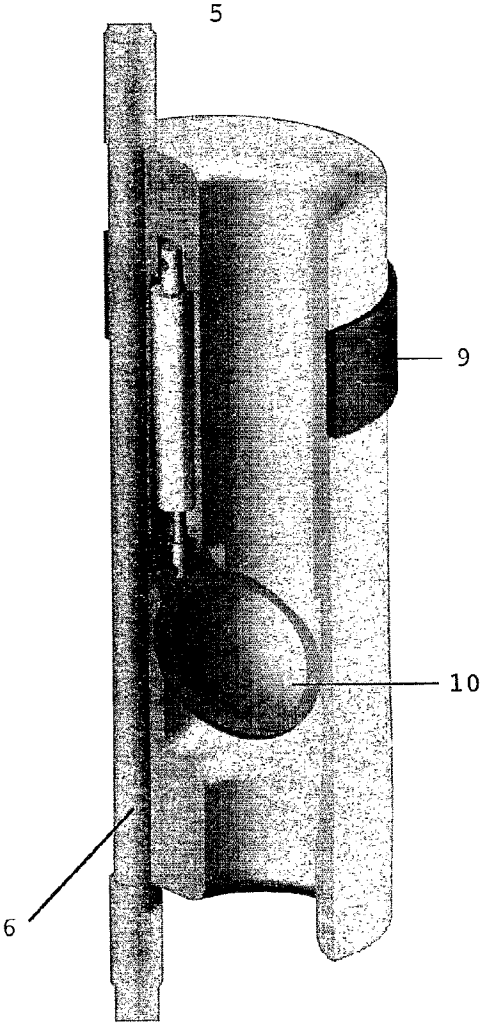
Figure 4:
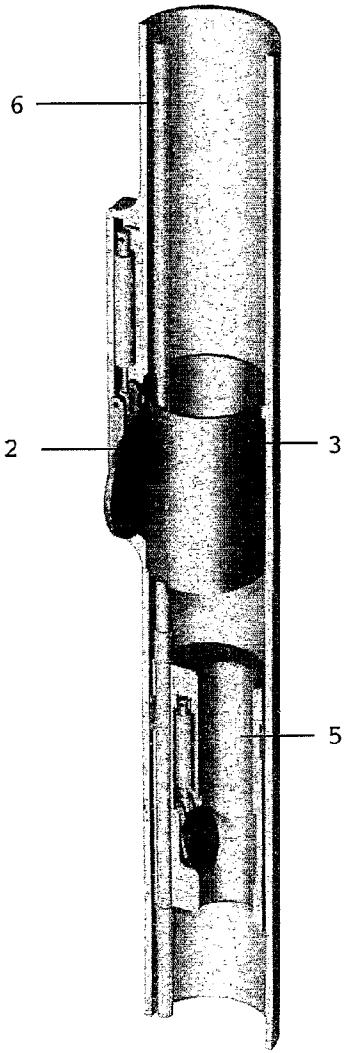
Figure 5:
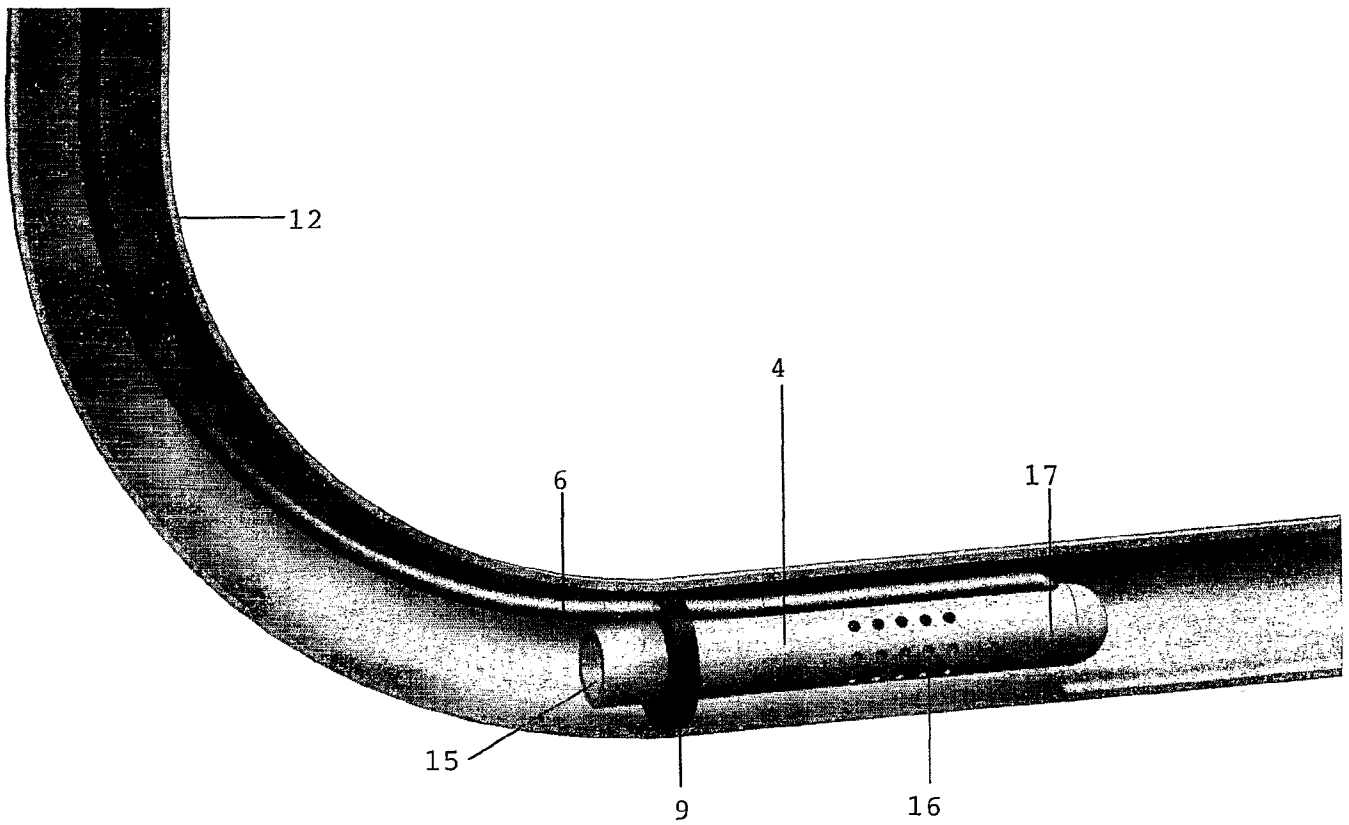

The present invention is illustrated by figures, of which FIG. 1 shows a cross-section view of wells with a horizontal valve tree and a vertical valve tree, respectively, modified in accordance with the present invention, FIG. 2 shows further details of the horizontal valve tree, FIG. 3 shows further details of the vertical valve tree, FIG. 4 shows details concerning the sleeve body and the electrically operated downhole valve, and FIG. 5 shows further details concerning the downhole pump.

DETAILED DESCRIPTION

Firstly reference is made to FIG. 1 that gives sectional view of two embodiments of modified subsea arranged oil production wells in accordance with the present invention, more particularly a horizontal valve tree (Christmas tree) on the left side of the figure and a vertical valve tree (Christmas tree) on the right side of the figure. A horizontal valve tree is often applied subsea, among other things because bigger production tubes are rendered possible in an easier way than for vertical valve trees. In FIG. 1, and on the other figures", identical or corresponding elements are denoted with identical reference numerals. In particular, FIG. 1 shows two subsea arranged oil production wells 1 in accordance with the present invention, each well has a hydraulically operated subsea arranged downhole valve 2 installed in a position within the production tubing some distance the valve tree. However, the hydraulically operated subsea arranged downhole valve 2 is in both embodiments illustrated in FIG. 1 locked in an open position by way of a sleeve body 3 arranged in a locking position in the production tubing. Furthermore, for both embodiments an electrically operated downhole pump 4 is illustrated which is arranged in the production tubing below the locked-in-open-position hydraulically operated downhole valve 2. Furthermore, an electrically operated downhole valve 5 is illustrated below the hydraulically operated downhole valve, but above the downhole pump, i.e. in position within the production tubing between the sleeve body 3 and the downhole pump 4. The sleeve body 3 must be understood as a blocking device of any know type that enables blocking of the former installed valve in an open position without blocking the complete flowing cross section in the production tubing.

Further reference is made to FIG. 2 illustrating in more details a subsea arranged horizontal valve tree. In particular, a production tubing hanger 7 is shown on the top of the valve tree having an electrically high voltage connector 8 arranged in the centre, which connector is advantageously operable using ROV, i.e. a ROV (Remotely Operated Vehicle) may be connected and disconnected. The electrical cable is located in the well inside the coiled tubing in a protected position. Within the production tubing 12, sealingly positioned between the coiled tubing 6 and the inner part of the production tubing 12, located above the outlets of the production flow and the killing/extinguishing flow, there are packers/gaskets 9. More particularly, two former plugs in horizontal valve trees are replaced with two packers 9 or two coiled tubing plugs 9, which plugs/packers have preferably been arranged in advanced on the coiled tubing before the latter is guided down into the production tubing. The coiled tubing 6 having a power cable installed inside (power and signal cable) is extended down into the production tubing 12, which tubing is extending in the well all the way down to the perforated production zone (not shown). The wellhead comprises a wellhead housing 10 and well casing hangers 11.

FIG. 3 illustrates in a similar way as for FIG. 2 a valve tree, but in this case a vertical subsea arranged valve tree. As for FIG. 2 a well head housing 10, coiled tubing with power cable 6, production tubing 12 and casing hangers 11 are shown. Furthermore, a Production Master Valve 13 and a Production Swab Valve 14 are indicated. However, said two valves have been replaced with a coiled tubing plug 9 to replace the upper valve, and an electrically operated valve 5 to replace the second valve. In the illustrated embodiment said electrically operated valve 5, in correspondence to the electrically operated valve 5, is installed down in the production tubing. This is considered advantageous. However, other types of valves may also replace the lower valve in the valve tree.

FIG. 4 illustrates in further details a downhole valve providing a downhole safety valve barrier. Due to the coiled tubing which would block the closing of the existing hydraulically operated downhole valve a new downhole, electrical safety valve with reduced through-put opening is installed, while the existing hydraulic downhole valve is blocked or locked in an open position. More particularly, it is illustrated that the hydraulically operated downhole valve 2 is blocked with a sleeve body 3, while an electrically operated downhole valve 5 with reduced through-put opening is arranged below the blocked valve. The right side of the figure shows some more details. In particular, it shows in detail that the coiled tubing 6 is built inside a sleeve body, where moreover the valve is built-in. At the outside of the sleeve body at least one packer 9 exist that can hold the sleeve body in a sealing position, while inside the sleeve body the through-put opening may be blocked by a flap-valve (flapper), a ball valve or another suitable valve that, as for the packers, is advantageously electrically operated by use of power from the electrical cable of the coiled tubing. In a preferred embodiment of the invention the electrically operated downhole valve 5 is integrated in the sleeve body 3.

In FIG. 5 the electrical downhole pump 4 is further illustrated as arranged deep down in a production tubing 12. The pump 4 is illustrated in a position where the well is bent out towards a horizontal orientation so that the whole lifting height is present downstream of the pump outlet 15. Furthermore, the pump has an inlet 16, one or more packers 9 that may hold the pump in position and to isolate the suction side and pressure side of the pump, and a pump motor 17. The pump 4 is arranged at the end of the coiled tubing 6 that contains a power/signal cable. A downhole pump that can increase the production in a well from 1000 barrels per day to 4000 barrels per day, having a lifting height of 100 bar, and with an efficiency of 0.7, would by order of magnitude require 100 kilowatt of energy supply to the pump. A coiled tubing with a diameter of 1 inch (2.54 cm) would in general be sufficient to both contain the cable and to hold the pump and the other devices.

The method according to the invention may in full details have many different embodiments, wherein the simplest are exercised in a "killed" production well. For performance in operable/alive wells as many devices as possible are preinstalled on the coiled tubing prior to the guiding of the tubing down into the well. Prior to guiding the coiled tubing down in the production tubing, it is advantageous to arrange on the coiled tubing the electrically operated downhole pump in the end of the coiled tubing and the sleeve body and the electrically operated downhole valve on the coiled tubing above the downhole pump (preferably integrated in a unit), the packer devices in form of coiled tubing plugs and valves further up the coiled tubing, and the coiled tubing hanger with an integrated connection plug in position which is adjusted sealingly dependent in the production tubing hanger.

With a riser connected, the packers or barriers located inside and farthest up in the valve tree may be pulled out. Afterwards, under pressure control on the surface and on a surface vessel, the coiled tubing string may be inserted via the riser while the existing hydraulic valve is open. It is possible to use only known methods and equipment for the modification method, including testing. However, it may with advantage be developed improved equipment and improved methods to ease the implementation of the method according to the invention.

The invention claimed is:

1. A method to modify an existing subsea arranged oil production well having installed close to an upper part of the well a hydraulically operated downhole valve, said method comprising the steps of:

using coiled tubing technology to:

arrange an electrically operated downhole pump deep down in the production tubing;

lock the hydraulically operated downhole valve in an open position by placing a sleeve body in the open positioned valve; and arrange an electrically operated downhole valve above the downhole pump, wherein said sleeve body and said electrically operated downhole valve are integrated in one unit.

2. The method according to claim 1, further comprising the step of arranging a coiled tubing hanger on the well head or in the valve tree on the seabed.

3. The method according to claim 1, further comprising the step of arranging two coiled tubing plugs on the coiled tubing.

4. The method according to claim 1, further comprising the step of replacing two valves in vertical valve trees with a coiled tubing plug as replacement for the upper valve and an electrically operated valve as replacement for the second valve.

5. The method according to claim 4, further comprising the step of arranging the coiled tubing plug and the electrically operated valve on the coiled tubing in advance.

6. The method according to claim 1, wherein, prior to guiding the coiled tubing down in the production tubing, arranging the following on the coiled tubing:

the electrically operated downhole pump at the end of the coiled tubing, the sleeve body and the electrically operated downhole valve on the coiled tubing located above the downhole pump, packer devices in the form of coiled tubing plugs and valves further up on the coiled tubing, and a coiled tubing hanger having an integrated connection plug in position adjusted sealingly dependent in the production tubing hanger.

7. A modified subsea arranged oil production well, the well being modified by applying the method according to claim 1, said well comprising:

an electrically operated downhole pump in the production tubing;

a sleeve body that locks a prearranged, hydraulically operated downhole valve in the production tubing in an open production; and an electrically operated downhole valve in the production tubing, located above the downhole pump.

8. The modified subsea arranged oil production well according to claim 7, wherein the downhole pump, the sleeve body and the electrically operated downhole valve are arranged on a coiled tubing that is hanging on a coiled tubing hanger on the well head or a valve tree on the seabed.

9. The modified subsea arranged oil production well according to claim 8, wherein a cable is arranged within the coiled tubing, and the cable is hanging in a sealing way down from a connection in the coiled tubing hanger, into which connection power and signals to operate the downhole pump and the downhole valve may be supplied.

10. The modified subsea arranged oil production well according to claim 9, wherein power and signals to operate the downhole pump and the downhole valve are remotely controlled by use of a ROV.

* * * * *